US005462235A

United States Patent [19]

Driscoll et al.

[11] Patent Number: 5,462,235

[45] Date of Patent: Oct. 31, 1995

[54] AGGREGATE PRODUCING MACHINE

[75] Inventors: Mary E. Driscoll, Lexington; Karl D. Taub, Boxboro, both of Mass.

[73] Assignee: W. R. Grace & Co.-Conn., New York, N.Y.

[21] Appl. No.: 986,817

[22] Filed: Dec. 8, 1992

[51] Int. Cl.[6] ..... B02C 13/286; B02C 13/288

[52] U.S. Cl. ..... 241/30; 241/57; 241/282; 241/295

[58] Field of Search ..... 241/30, 57, 280, 241/282, 293, 295

[56] References Cited

U.S. PATENT DOCUMENTS

| | | | |
|---|---|---|---|
| 1,032,720 | 7/1912 | Wolford | 241/282 X |
| 2,319,040 | 5/1943 | Conklin | 241/3 X |
| 2,600,964 | 6/1952 | Borton et al. | 241/3 X |
| 2,697,247 | 12/1954 | Bettes, Jr. | 241/3 X |
| 3,237,873 | 3/1966 | Raski | 241/27 |
| 3,627,211 | 12/1971 | Leach | 241/3 |
| 3,630,820 | 12/1971 | Leach | 241/3 X |
| 3,825,194 | 7/1974 | Buell | 241/191 |
| 4,085,897 | 4/1978 | Hahn et al. | 241/57 X |
| 4,293,982 | 10/1981 | Marx | 241/295 X |
| 4,361,290 | 11/1982 | Francis | 241/57 |
| 4,923,126 | 5/1990 | Lodovico et al. | 241/30 |
| 5,127,588 | 7/1992 | Schmidt | 241/295 X |
| 5,129,587 | 7/1992 | Neefe | 241/27 |

FOREIGN PATENT DOCUMENTS

| | | | |
|---|---|---|---|
| 506065 | 8/1920 | France | 241/282 |
| 1298867 | 7/1969 | Germany | 241/282 |
| 2538175 | 3/1977 | Germany . | |
| 1342354 | 1/1974 | United Kingdom . | |

OTHER PUBLICATIONS

*Best of Fine Woodworking*, Sep., 1990, p. 50, The Taunton Press, Inc. (Reprint from *Fine Woodworking*, May 1988).

*Primary Examiner*—Frances Han

*Attorney, Agent, or Firm*—Nicholas P. Triano, III; William L. Baker

[57] ABSTRACT

An apparatus for producing shredded aggregate from, e.g., boards of expanded polystyrene, is described. The apparatus includes a shredding box defining a shredding chamber; a rotor housed in the shredding box; means for driving the rotor; a plurality of saw blades coupled to the rotor in linear succession, each saw blade having a plurality of spaced apart teeth, each successive saw blade being coupled to the rotor such that its teeth lie about halfway between the teeth of an adjacent saw blade; receiving means in the shredder box for receiving material to be shredded; and take-away means coupled to the shredder box for removing shredded material from the shredding chamber. Low density (e.g., 0.4–0.5 pcf loose bulk density) material having a uniform particle size distribution over time can be economically produced.

17 Claims, 5 Drawing Sheets

AGGREGATE PRODUCING MACHINE

BACKGROUND OF THE INVENTION

In the course of erecting steel structures, a thick coating of inorganic material is commonly applied to the metallic structural elements to achieve a number of objectives including fire retardance, improved appearance and sound deadening. While several types of formulations have been used for these purposes over the years by means of a variety of techniques, one successful system consists of spraying onto the steel surfaces settable aqueous mixes as disclosed in U.S. Pat. No. 4,751,024, assigned to the assignee of the present invention. That patent teaches sprayable cementitious fireproofing compositions containing shredded expanded polystyrene as a lightweight aggregate.

In order to be suitable for such use, coating mixes, both in the wet and dry state, must possess a number of important properties. They must be able to hold a quantity of water that renders them capable of being pumped easily and to great heights, yet they must retain a consistency sufficient to prevent segregation or settling of ingredients and permit adequate "yield" or coverage of the steel surface at a given thickness. The coating mixes, furthermore, must obviously adhere to steel surfaces, both in the slurried state and in the dry state. Also, the mix must set without undue expansion or shrinkage which could result in the formation of cracks that would seriously deter from the insulative value of the dry coating.

Published European Patent Application No. 90308027.3, the disclosure of which is incorporated herein by reference, teaches that sprayable cementitious fireproofing compositions containing shredded polystyrene having a particular particle size distribution result in compositions having better uniform consistency and quality in terms of pumpability, hangability and yield. In the aforementioned European Patent Application it is disclosed that in shredding the polystyrene to achieve the desired particle size distribution, important considerations include: the degree of fusion in the expanded polystyrene board used as a starting material for the aggregate, the shredding rotor speed, the roughness of the brushes on the shredder and the tolerance between the brushes. With particular reference to the shredder brush parameters, it has been found that reproducible particle size distribution becomes difficult as the brushes wear; in particular, the proportion of particles we define as "fines", i.e., less than about 325 mesh, increases to an unacceptable level.

Furthermore, the machine disclosed in the aforementioned European Patent Application is difficult to maintain and operate; the wire brushes are difficult to clean, and the whole apparatus has been found prone to overheating. When this occurs the expanded polystyrene in the shredder melts and gums up the wire brushes, necessitating their replacement. This is a bothersome and costly proposition.

It therefore would be desirable to produce a shredding machine that, over long periods of operation, will produce a shredded aggregate having a consistent particle size distribution; that is more durable; that is easy to maintain; and that can be made easily and inexpensively.

SUMMARY OF THE INVENTION

In accordance with the present invention, there is provided apparatus for shredding expanded polystyrene such that the shredded character of the polystyrene resulting therefrom falls within a predetermined particle size distribution that remains essentially constant over an extended period of machine operation. In general terms, the apparatus includes a shredding box defining a shredding chamber; a rotor housed in the shredding box; means for driving the rotor; a plurality of saw blades coupled to the rotor in linear succession, each saw blade having a plurality of spaced apart teeth, each successive saw blade being coupled to the rotor such that its teeth lie about halfway between the teeth of an adjacent saw blade; receiving means in the shredder box for receiving material to be shredded; and take-away means coupled to the shredder box for removing shredded material from the shredding chamber. Low density (e.g., 0.4–0.5 pcf loose bulk density) aggregate having a uniform particle size distribution over time can be economically produced from plastic foam boards (e.g., expanded polystyrene).

DETAILED DESCRIPTION OF THE INVENTION

Figure 1:
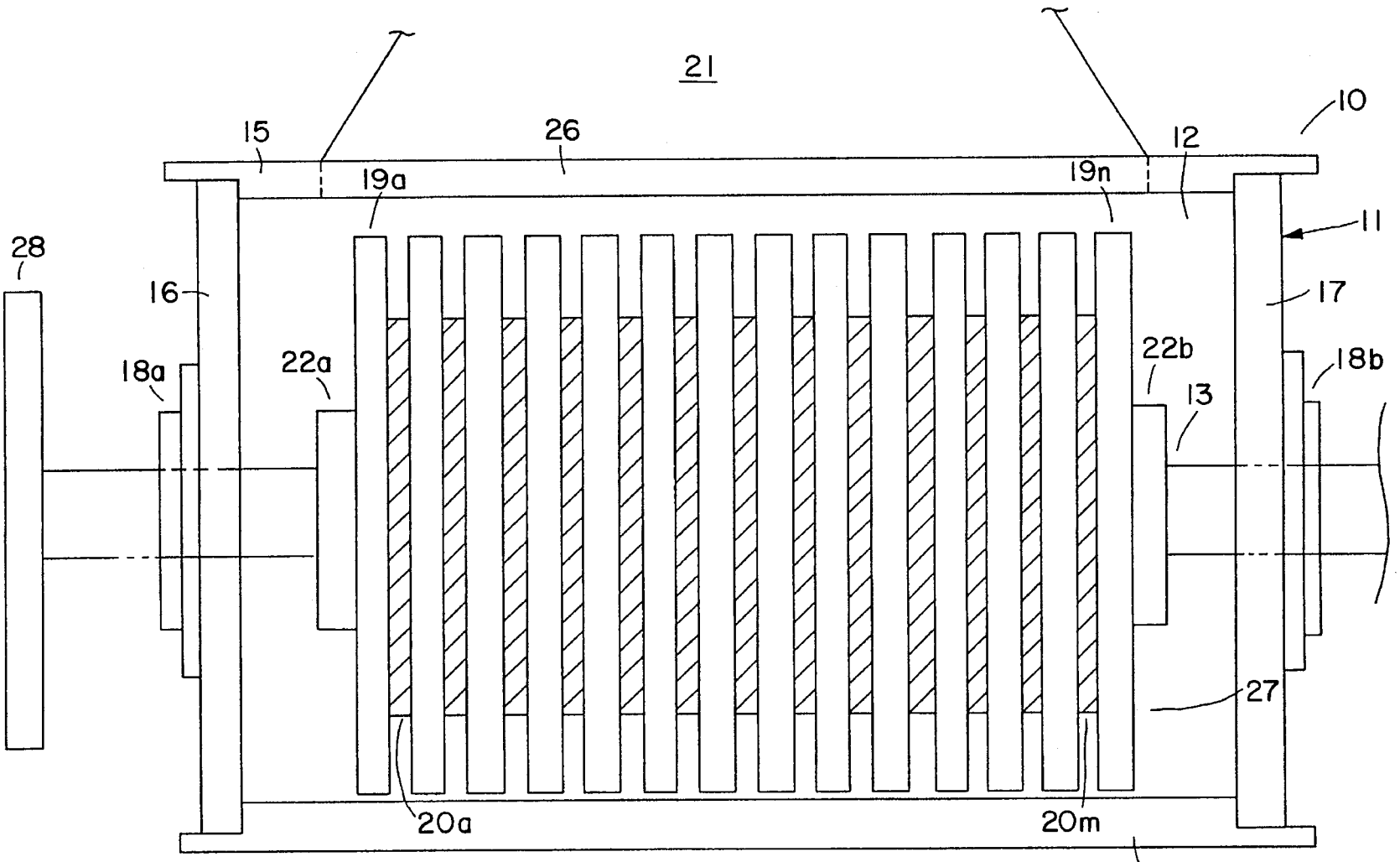
FIG. 1 is a front view of the shredder unit assembly in accordance with the present invention, with the front plate of the shredder head assembly removed to show the shredder head in detail.

Turning now to the drawings, FIGS. 1 to 7 depict the present invention in a preferred embodiment. At FIG. 1 there is shown generally at 10 the shredder unit assembly of the present invention. Shredder box 11 defines a chamber 12 in which rotor 13 is housed. Shredder box 11 has a base plate 14, a top plate 15, and side plates 16, 17 having apertures through which the rotor passes. The plates are preferably separate pieces, held securely together by, for example, socket screws. This allows easy access to chamber 12, and allows any failed part to be replaced individually. Preferably the plates are formed of ¾" aluminum, but any material that will provide the necessary structural support for the unit will work. The rotor 13 is connected to heavy duty bearings 18*a* and 18*b*, which allow the rotor to spin about its longitudinal axis.

A plurality of circular cutting means, depicted as industrial circular saw blades 19*a*–19*n*, are coupled to the rotor shaft. Preferably the blades are of the 7 ¼" flooring type, each having 14 carbide teeth ground in the triple-chip configuration, oriented at a negative 10° hook angle. The grind and the hook as angle reduce the amount of power necessary to drive the rotor through the board, and minimize excessive tearing of the plastic. The blade plates preferably are 0.70" thick and the carbide teeth are 0.112" wide. Spacers 20*a*– 20*m*, preferably made of 0.010–0.070" thick nylon, are sandwiched between adjacent blades along the rotor shaft, in order to create a gap of less than 0.05" between the teeth on adjacent blades. Too large a gap between the blades will allow unshredded board to push between the blades, while too small a gap would require the use of more blades per length of the rotor shaft, thereby increasing the weight and the cost of the apparatus. The blades have 0.5×0.5" gullets, which, in conjunction with the gap between the blades, allow sufficient space for the shredded particles to be carried to the take-away vent. The space also allows for heat dissipation, preventing softening or melting of the polystyrene. Blades 19*a*–19*n* and spacers 20*a*–20*n* define shredder head 27, whose width should be at least slightly greater than that of the board being fed against it.

The blades are alternately staggered such that the teeth on one blade lie about halfway between the teeth on adjacent blades. This relationship is best shown in FIG. 2, wherein blade 30*a* is shown superimposed over blade 30*b*, in the staggered alignment such as when assembled onto the rotor means depicted in FIG. 1. Note that the teeth of blade 30*b* lie about halfway between the teeth of blade 30*a*. Spacer 31 is shown as a dotted line to indicate its placement between blades 30*a* and 30*b*. This arrangement is important because were adjacent teeth aligned side by side, the teeth would effectively act as a single large tooth and cut unacceptably large particles from the polystyrene board.

Figure 3A:
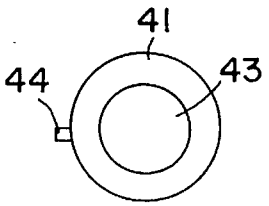
FIGS. 3 and 3*a* depict the rotor of FIG. 2 in top view and side view, respectively.
Figure 3:
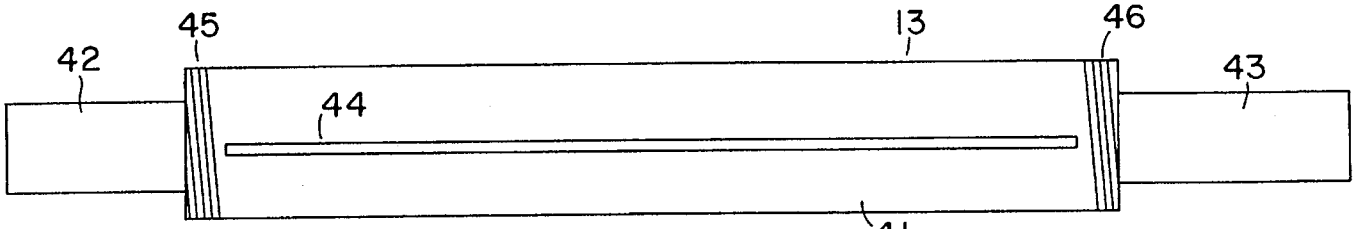

Rotor 13 is shown in more detail in FIG. 3. The rotor 13 consists of a shaft 41 having two ends 42, 43 of smaller diameter than the shaft. A keyway 44 is formed in the body of shaft 41 to fix the offset orientation of the blades as discussed above. A two inch diameter shaft has been found to be suitable, with ends 42, 43 machined to a diameter of 1.5". A 0.25"w×0.25"h keyway 44 extends along substantially the entire length of shaft 41. The keyway need not extend along the entire length of shaft 41, as space between the blades and the side walls 16, 17 is preferred, as well as space for threads 45 and 46, which are provided in order to allow coupling of locking nut means 22*a* and 22*b*. Locking nut means 22*a* and 22*b* are provided for retaining and compressing the blades and spacers. Where the length of shaft 41 is 27.75" (not including ends 42, 43), a suitable keyway length is 25.75". Keyway 44 is better depicted in the side view of rotor 13, shown in FIG. 3*a*. The diameter of shaft 41 is desirably sized so that blade mounting hole 32 (FIG. 2) will fit over shaft 41. Keyhole 33, which is situated at the perimeter of blade mounting hole 32 and communicates with the opening, is formed in a complementary shape to fit over keyway 44. Note that by machining keyhole 33 at different locations along the perimeter of blade mounting hole 32 on individual blades, one of ordinary skill in the art will see that the desired blade teeth staggering can be achieved.

Figure 2:
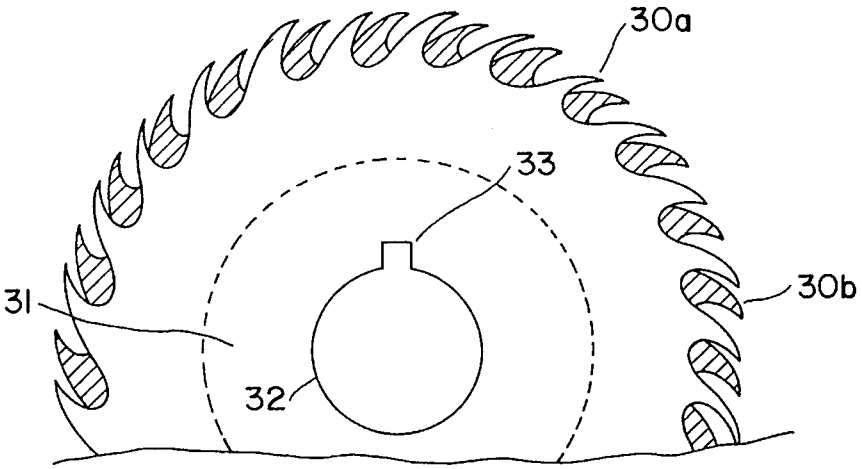
FIG. 2 depicts the staggered relationship of the invention of cutting teeth on adjacent cutting means.
Figure 4:
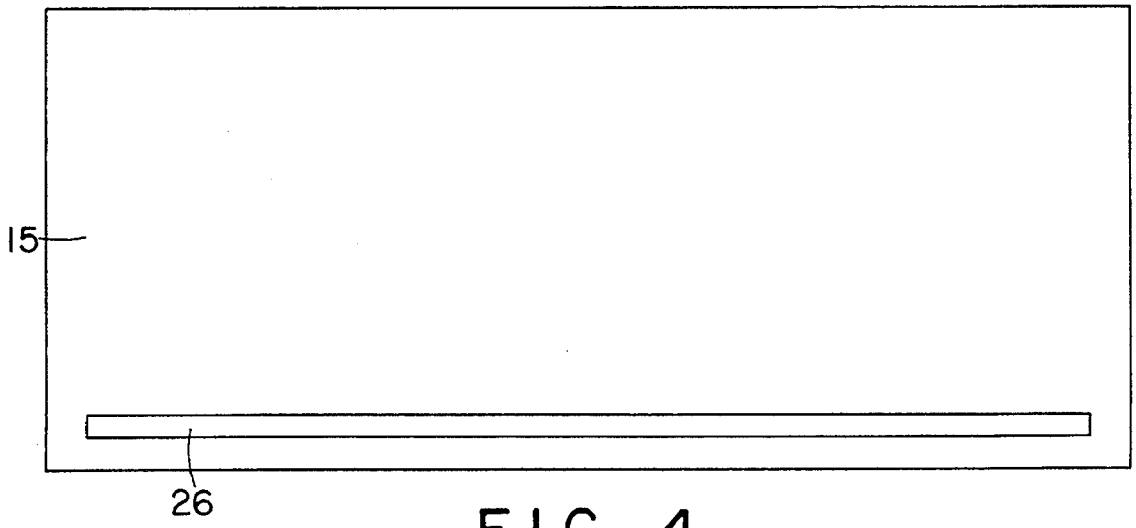
FIG. 4 is a top view of the top plate of one embodiment of the shredder unit assembly of the present invention.
Figure 5:
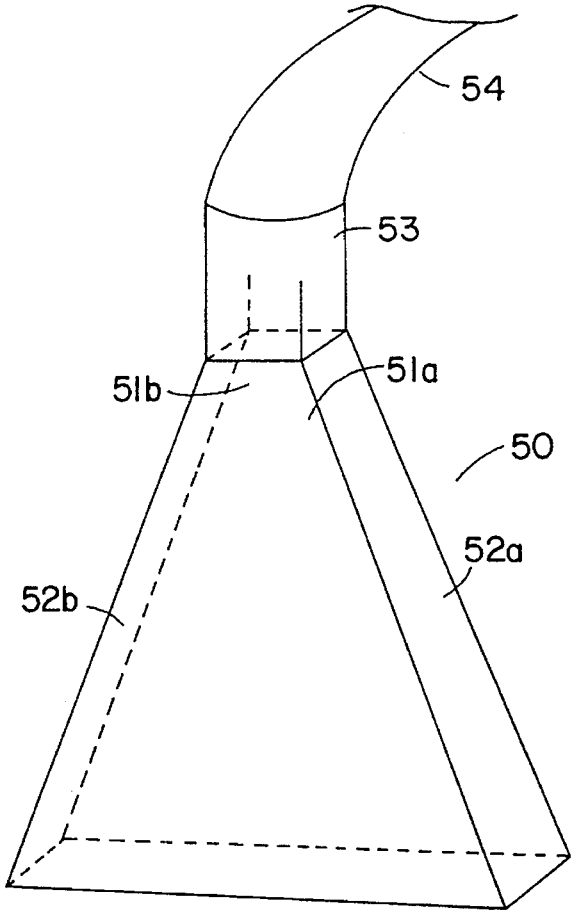
FIG. 5 is a perspective view of the take-away system used in the present invention.

The top plate 15 (FIG. 4) of shredder box 11 has an aperture 26 (the width of which is denoted by dotted lines in FIG. 1 ) which allows fluid communication between chamber 12 and an air take-away system, shown partially in FIG. 1 as element 21. Preferably aperture 26 is formed directly above the interface of the board and the rotor. Such placement allows for a more efficient fluid flow and provides for rapid removal of the shredded aggregate particles from chamber 12. FIG. 5 depicts, in more detail, the take-away system 50, which comprises a chamber formed by trapezoidal front and back pieces 51*a* and 51*b*, joined along their sides to a pair of smaller trapezoidal side pieces 52*a* and 52*b*. A collar adapter 53 is coupled to the top of the resulting chamber, and a hose 54 can be attached thereto for sucking shredded aggregate particles out of chamber 12, and to a suitable receptacle such as a bag house. Take-away system 50 is preferably joined at its base directly to aperture 26 by welding, or more preferably, by metal screws or bolts to allow service of the take-away system, e.g., for removal of blockages.

Figure 6A:
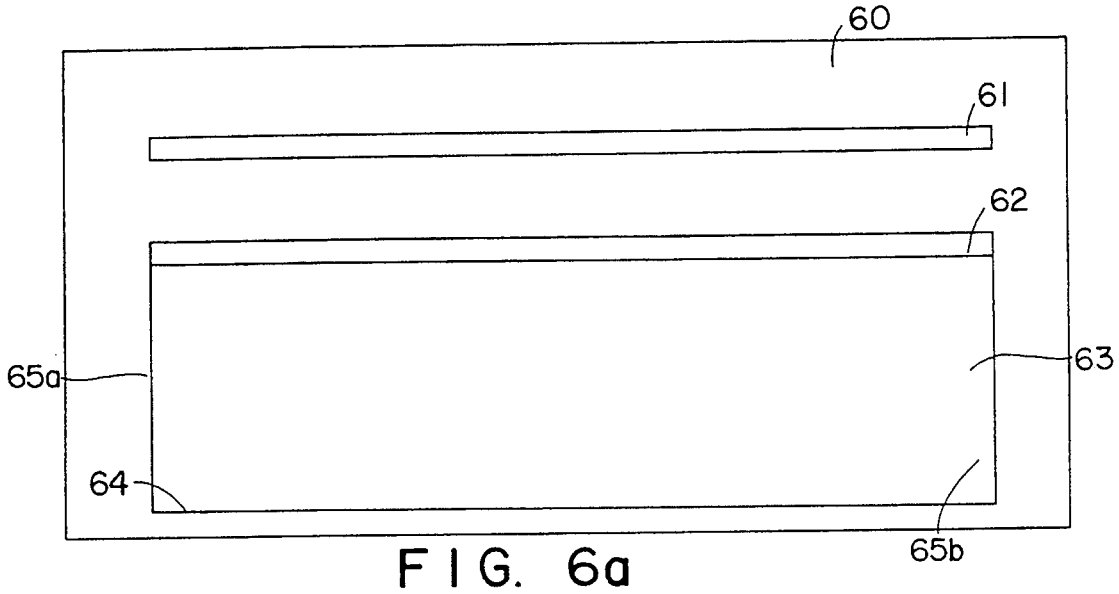
FIGS. 6*a*–6*c* are front, side and top views, respectively, of the front plate of one embodiment of the shredder unit assembly of the present invention.
Figure 6B:
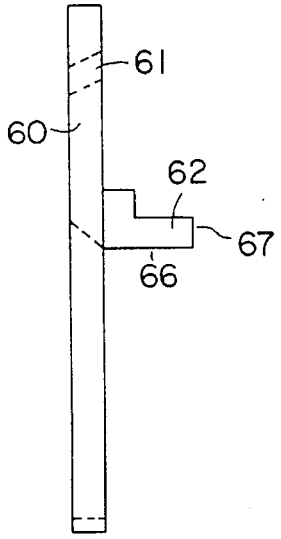
Figure 6C:
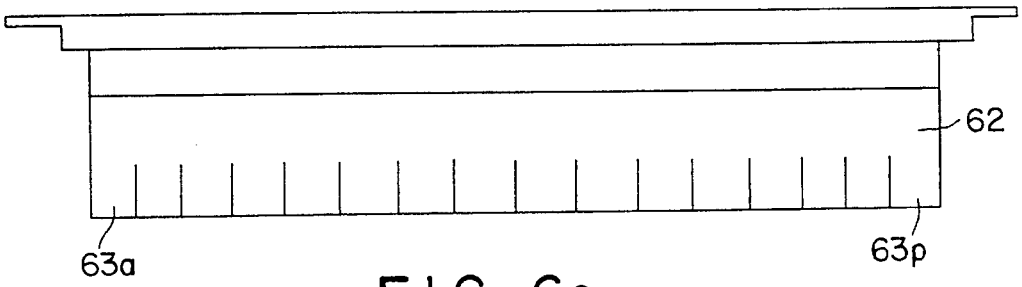

FIGS. 6*a*–6*c* illustrate, in front, side, and top view, respectively, the front shredder box plate 60, which functions as a means for receiving material to be shredded. The front plate 60 includes an air inlet aperture 61, preferably formed at a 45° angle as shown in FIG. 6*b*. The provision of inlet aperture 61 allows for better and more efficient removal of the shredded particles being sucked into take-away system 50. The air flow through chamber 12 can be controlled by varying the size of the inlet aperture 61; if a large volume of shredded material is moving through the chamber, a larger aperture 61 would be desirable. Thus aperture 61 may be desirably fitted with a slidable shutter to enlarge or narrow the aperture size. Aperture 61 is also preferably angled so that any solid debris, i.e., rocks, or bolts, hit by the spinning shredder head has a lessened chance of flying directly out the aperture and injuring plant personnel. A top board feed guide 62 (best seen in FIG. 6*b*) extends out from plate 60. Guide 62 is chamfered at, e.g., about 35°, to assist the insertion of the leading edge of a polystyrene board to be shredded into opening 63, which is defined by surface 66 of guide 62, sides 65*a* and 65*b*, and bottom edge 64 (which edge is flush with the top surface of base plate 14.) The height of opening 63 is preferably slightly smaller than the thickness of the board, e.g., for a 3" thick board, an opening height of about 2.8" is suitable. In this manner, the board is compressed and thus prevented from moving against the face of the rotor, which can cause incompletely shredded particles to be pulled from the board. Excessive noise is also eliminated. Preferably guide 62 is made of a semi-rigid thermoplastic material, which has been sliced to create flat fingers depicted as fingers 63*a*–63*p*. The fingers ensure that the guide is rigid enough to hold the board securely, yet flexible enough at any individual point to give way and allow debris (such as small bolts), embedded in the board during manufacture or storage, to pass through before the debris becomes embedded in the shredder head, avoiding head replacement and costly down time of the machinery.

Edge 67 is placed in close proximity to the spinning shredder head, i.e., less than 0.25". Also, the top surface of base plate 14 is just below the bottom point of shredder head 27, i.e., less than 0.25". This arrangement is necessary to ensure that the board is fed in the space between the center line of the rotor and the bottom of the shredding head. With the rotor spinning upwards with respect to the board being fed into it, the end of a first board to be shredded will be held against the rotor by the next board to be shredded, until the first board is fully shredded. This prevents formation of skins and chunks of plastic.

Rotor 13 can be driven by a motor (not shown), and coupled thereto by a belt connected to pulley 28. Rotor speed is adjusted by valving the size of the pulleys attached to the drive motor and/or the rotor shaft. A rotor speed of from 1500–6000 rpm, preferably from 2000–4000 rpm has been found to be suitable for the production of shredded expanded polystyrene. An increase in rotor speed will create an almost proportional decrease in particle size. The same effect can be more easily achieved by varying the feed rate of the board, with a faster feed rate creating larger particles.

Figure 7:
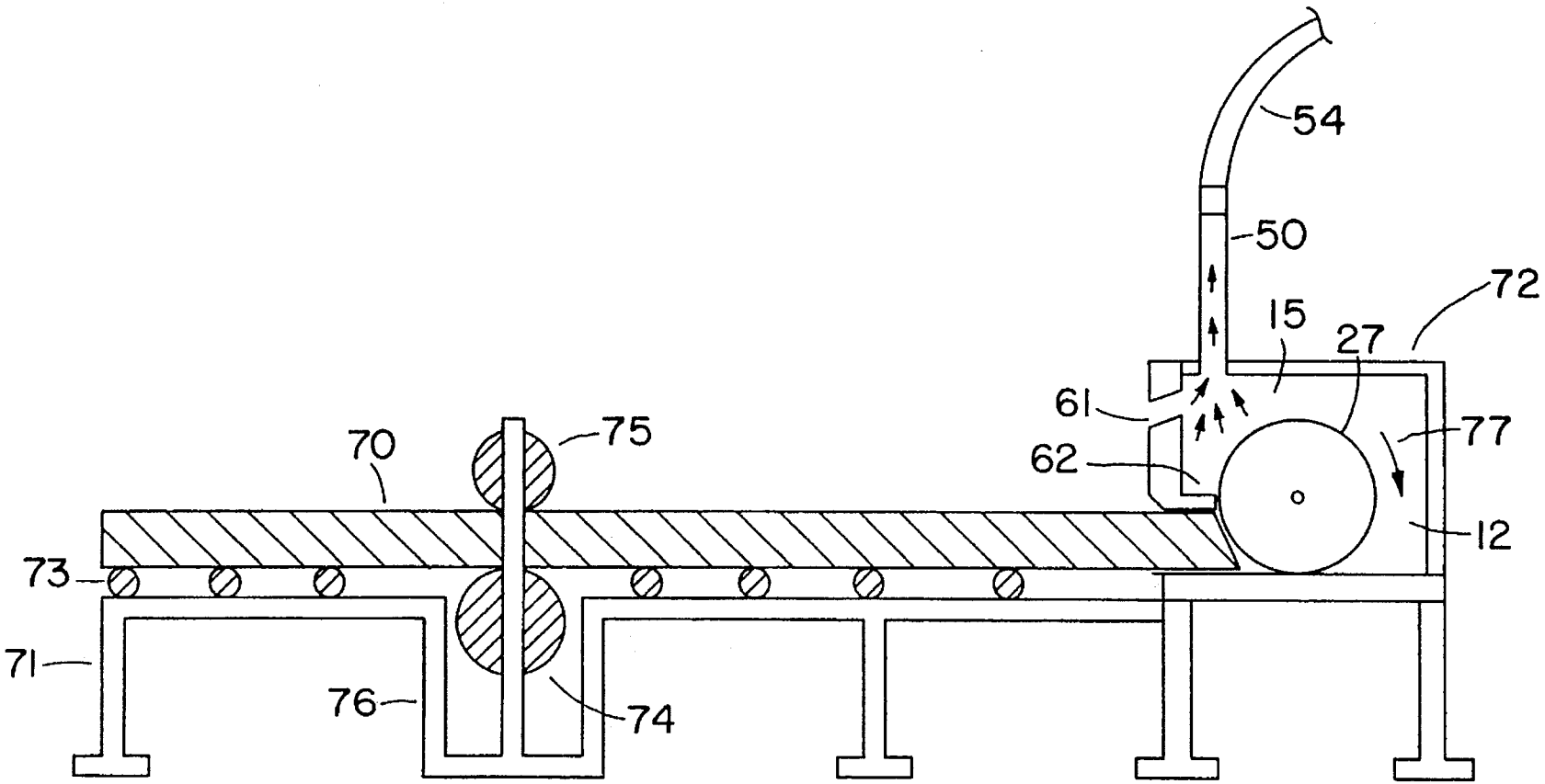
FIG. 7 depicts a preferred embodiment of a method for making shredded aggregate, employing the shredder unit assembly of the invention.

Referring now to FIG. 7, the operation of the machine, and a method for making shredded plastic aggregate, will now be described. Expanded polystyrene board 70 is placed on a board feeder means 71, for feeding into shredder 72. Board feeder means 71 comprises roller means 73 for rolling and supporting board 71 along its length, and drive means 76 further comprising drive roller means 74 and passive friction roller means 75. Drive roller means 74 is suitably powered, preferably coupled to a variable electric motor in a manner wherein the drive speed can be changed as necessary. (As will be described hereinbelow, the drive speed, shredder head speed, and head design (i.e., number of blades and number of teeth/blade) are interrelated factors governing the quality of shredded material produced.) Friction roller means 75 frictionally engages board 70, thus allowing drive roller means 74 to frictionally engage it and move the board into the shredder 72.

As the leading edge of board 70 enters the shredder chamber 12, shredder head 27 is rotating (in the direction indicated by arrow 77) into the board. Board 70 moves into the teeth of spinning shredder head 27, producing shredded aggregate particles indicated by the small upward pointing arrows. The shredded aggregate particles are sucked into take-away system 50 and hose 54, which leads to, e.g., a bag house where the shredded material is stored for packaging and shipment. As an alternative to a bag house, hose 54 could feed shredded material directly into a manufacturing process requiring the shredded material as a component material, e.g., in making fireproofing compositions substantially as described herein. Such an is arrangement would eliminate storage of the material (which takes up a lot of space) and would thus save money and reduce waste, since only as much shredded material as needed for the manufacturing process need be made. An air moving system, e.g., a vacuum (not shown), provides the suction force for removing the shredded material, aided by the air stream provided thorough inlet aperture 61.

As mentioned earlier, the board feed rate (drive speed), shredder head design, and head speed, are interrelated factors having a direct affect on the quality (and quantity) of shredded aggregate produced. For example, we have found that an excellent quality shredded aggregate for use in cementitous fireproofing materials can be made with a shredder head and head speed substantially described hereinabove, and a board feed rate of from about 0.05 to 0.4 feet/second, preferably from about 0.2 to 0.3 feet/second. Generally, feeding the board faster will result in a particle size distribution having predominantly larger particles, whereas spinning the head faster produces smaller particles. Such variations in the aforementioned parameters are intended and are within the scope of the present invention, as there are many uses for shredded aggregate, each of which demands aggregate of different characteristics.

What is claimed is:

1. A method of shredding expanded polystyrene board, comprising:

a) providing a shredding apparatus for shredding a board, said shredding apparatus comprising a shredding box defining a shredding chamber; a rotor housed in said shredding box; means for driving said rotor; a plurality of cutting means coupled to said rotor in linear succession, each cutting means having a plurality of spaced apart teeth, each successive cutting means being coupled to said rotor such that its teeth lie about halfway between the teeth of an adjacent cutting means, said plurality of cutting means defining a shredder head; board orientation means for receiving said board and orienting it into contact with said shredder head in the space between the center line of the rotor and the bottom of the shredder head, comprising i) an opening for receiving said board, the height of said opening sized slightly smaller than the thickness of said board; and ii) top board feed guide means for supporting substantially the entire top surface of said board in said shredding chamber, said board feed guide means further comprising an edge in close proximal contact with said shredder head; and take-away means, coupled to said shredder box for removing shredded material from said shredding chamber, said take-away means communicating with said shredding chamber via an aperture located above the interface of said shredder head and said board guide means;

b) causing said shredder head to rotate at a speed sufficient to shred said board and produce shredded aggregate;

c) feeding said board into said shredding chamber so as to contact said board with said shredder head, thus making shredded aggregate; and d) removing from said chamber said shredded aggregate.

2. The method of claim 1, wherein said shredder head is caused to rotate between at least 1500 and 6000 rpm, and said board is fed into said shredding chamber at a rate of between 0.05 to 0.4 feet/second.

3. The method of claim 1, wherein said shredder head is caused to rotate between at least 2000 and 4000 rpm, and said board is fed into said shredding chamber at a rate of between 0.2 to 0.3 feet/second.

4. The method of claim 1, wherein said shredded aggregate is fed directly into a manufacturing process.

5. The method of claim 1, wherein said shredder head is caused to rotate between at least 1500 and 6000 rpm, and said board is fed into said shredding chamber at a rate of between 0.2 to 0.3 feet/second.

6. The method of claim 1, wherein said shredder head is caused to rotate in an upward direction with respect to a board being fed into said shredder head.

7. Shredding apparatus for shredding a plastic foam board, comprising:

a) a shredding box defining a shredding chamber;

b) a rotor housed in said shredding box;

c) means for driving said rotor;

d) a plurality of cutting means coupled to said rotor in linear succession, each cutting means having a plurality of spaced apart teeth, each successive cutting means being coupled to said rotor such that its teeth lie about halfway between the teeth of an adjacent cutting means, said plurality of cutting means defining a shredder head;

e) board orientation means for receiving said board and orienting it into contact with said shredder head in the space between the center line of the rotor and the bottom of the shredder head, comprising i) an opening for receiving said board, the height of said opening sized slightly smaller than the thickness of said board; and ii) top board feed guide means for supporting substantially the entire top surface of said board in said shredding chamber, said board feed guide means further comprising an edge in close proximal contact with said shredder head; and f) take-away means, coupled to said shredder box for removing shredded material from said shredding chamber, said take-away means communicating with said shredding chamber via an aperture located above the interface of said shredder head and said board guide means.

8. The shredding apparatus of claim 7, wherein said cutting means are circular saw blades, and wherein said plurality of teeth are carbide teeth ground in a triple-chip configuration and mounted at a negative 10° hook angle.

9. The shredding apparatus of claim 7, wherein each of said cutting means is spaced from a successive saw blade by less than 0.05".

10. The shredding apparatus of claim 7, wherein said rotor has a keyway formed substantially along the longitudinal length of said rotor for fixedly receiving said cutting means.

11. The shredding apparatus of claim 7 further comprising a board drive means for feeding into said shredding box said material to be shredded.

12. The shredding apparatus of claim 7, wherein said shredder head is adapted to spin on the axis of said rotor in an upward direction with respect to a board being fed into said shredder head.

13. The shredding apparatus of claim 7, wherein the top of said opening for receiving said board is chamfered at such an angle so that as said board to be shredded enters said opening for receiving said board, said top board feed guide compresses said board until the leading edge of said board contacts said shredder head.

14. The shredding apparatus of claim 13, wherein said chamfer angle is about 35°.

15. The shredding apparatus of claim 7, wherein said board orientation means is mounted within a front plate of said shredder box, said front plate further comprising an inlet aperture for allowing air into said shredding chamber.

16. The shredding apparatus of claim 15, wherein said inlet aperture is formed in said front plate at an angle of about 45°.

17. The shredding apparatus of claim 7, wherein said aperture is located, between said receiving means and said shredder head.

* * * * *